US005088948A

United States Patent [19]

Scheurer

[11] Patent Number: 5,088,948

[45] Date of Patent: Feb. 18, 1992

[54] BUOYANT BEVERAGE CONTAINER FOR SWIMMING POOL USE

[76] Inventor: Robert S. Scheurer, 1627 Midwestern Pkwy., Wichita Falls, Tex. 76302

[21] Appl. No.: 577,868

[22] Filed: Sep. 5, 1990

[51] Int. Cl.[5] ..... B63B 22/00

[52] U.S. Cl. ..... 441/1; 215/1 R

[58] Field of Search ..... 220/400, 415, 18, 901, 220/903; 441/1, 28; 215/1 R, 1 C, 13.1, 348

[56] References Cited

U.S. PATENT DOCUMENTS

| | | | |
|---|---|---|---|
| 3,698,025 | 10/1972 | Worobel | 441/28 |
| 3,831,209 | 8/1974 | Clingman | 441/1 |
| 4,443,203 | 4/1984 | Maertens | 441/28 |
| 4,571,194 | 2/1986 | Kiss et al. | 441/1 |
| 4,671,424 | 6/1987 | Byrns | 220/903 |
| 4,681,239 | 7/1987 | Manns et al. | 220/903 |
| 4,813,558 | 3/1989 | Fujiyoshi | 220/903 |
| 4,887,716 | 12/1989 | Abraham | 441/1 |

*Primary Examiner*—Jesus D. Sotelo
*Assistant Examiner*—Stephen P. Avila
*Attorney, Agent, or Firm*—Dennis T. Griggs

[57] ABSTRACT

A buoyant beverage container assembly includes a beverage container, a buoyant sleeve and a body of heavy ballast material encapsulated between a bottom cap and a retainer cap. The bottom cap includes a collar which, in combination with the retainer cap, defines an annular pocket in which the buoyant sleeve is secured. The ballast weight is selected to maintain the buoyant beverage container assembly upright in a body of water, without sinking when it is filled with beverage, and without turning over on its side when the container is empty or almost empty.

41 Claims, 8 Drawing Sheets

BUOYANT BEVERAGE CONTAINER FOR SWIMMING POOL USE

FIELD OF THE INVENTION

The present invention relates generally to beverage containers, and in particular to buoyant beverage containers which are adapted for use in connection with water sports activities.

BACKGROUND OF THE INVENTION

Water sports activities which are enjoyed in swimming pools may range from sunbathing and floating to high exertion game activities such as water polo and volleyball. There are a variety of accessories for use in and about swimming pools which make such pool activities more enjoyable. One such accessory is the pool float which is adapted to support a person in a reclining position on the surface of the water. That is, the pool float is a buoyant lounge on which a person can stretch out and relax for long periods of time, for sunbathing and the like.

Beverages are sometimes served in open containers on the deck of a swimming pool. Swimmers and others in the pool, for example, sunbathers on pool floats, must stop their pool activities and leave the water temporarily to enjoy a beverage on the deck. Beverages in open containers such as aluminum cans and glass bottles are ordinarily not taken into the swimming pool since the open beverage container is not buoyant and its contents may spill into the pool, and its hard surface may cause personal injury.

During some swimming pool activities, for example sunbathing on a pool float, it may not be desirable or convenient to leave the pool to enjoy a beverage. During such times, it would be desirable to provide a floating beverage container which would float upright and be conveniently available within the reach of the sunbather. Additionally, it would be desirable to provide such a floating beverage container for use by participants in a vigorous water sports activity, such as water polo, whereby beverage service could be made available in the pool by a beverage container which would float upright and would not tip over and spill its contents during the course of such activities.

DESCRIPTION OF THE PRIOR ART

It will be appreciated that conventional beverage containers made of metal, glass or plastic are unsuitable for use in connection with water sports activities. Moreover, metal and glass containers are not buoyant, and may cause personal injury if not handled properly. Buoyant beverage containers which are adapted to float upright in a swimming pool or the like are presently not available.

OBJECTS OF THE INVENTION

The principal object of the present invention is to provide a beverage container which is adapted to float upright in a swimming pool or the like.

A related object of the invention is to provide a floating beverage container which is adapted for use in a swimming pool during a water sports activity.

A general object of the present invention is to improve the upright stability of a beverage container.

Another object of the invention is to improve the upright stability of a beverage container holder of the type used to thermally insulate a metal, glass or plastic beverage container.

SUMMARY OF THE INVENTION

A beverage container assembly which is adapted to float upright in a swimming pool or the like includes a tubular beverage container which is inserted into a tubular sidewall of buoyant material. A body of heavy ballast material is secured onto the buoyant sidewall, and is encapsulated between a bottom cap and a retainer cap. The bottom cap includes a collar which, in combination with the retainer cap, defines an annular pocket in which the buoyant sidewall is secured. The bottom of the flexible beverage container rests against the top of the retainer cap, and is secured by the thermally insulated sidewall. The ballast weight is carefully selected to maintain the buoyant beverage container assembly upright in a body of water, without sinking when it is filled with beverage, and without turning over on its side when it is empty or almost empty.

In an alternative embodiment, the buoyant sidewall is closed at one end by a bottom panel. In this embodiment, the ballast body is confined between the bottom of the beverage container and the bottom panel of the buoyant holder. The ballast body and the flexible beverage container are held in place by frictional engagement between the external sidewall of the beverage container and the internal bore of the buoyant sidewall.

In yet another embodiment, the ballast body is provided by a collection of small metal shot which are confined between the bottom cap and the retainer cap.

The upright stability of an insulated beverage holder of the type adapted for holding and thermally insulating a metal, glass or plastic beverage container is improved by a ballast weight which is confined between a bottom cap and a retainer cap as previously described. In this arrangement, the holder has a thermally insulated sidewall which is inserted into the annular pocket and is secured thereto by an adhesive deposit. The beverage container is inserted into the insulation sleeve, and rests upon the retainer cap.

BRIEF DESCRIPTION OF THE DRAWINGS

Other objects and advantages of the present invention will be understood by those skilled in the art upon reading the detailed description which follows with reference to the attached drawings, wherein.

DETAILED DESCRIPTION OF THE PREFERRED EMBODIMENTS

Figure 1:
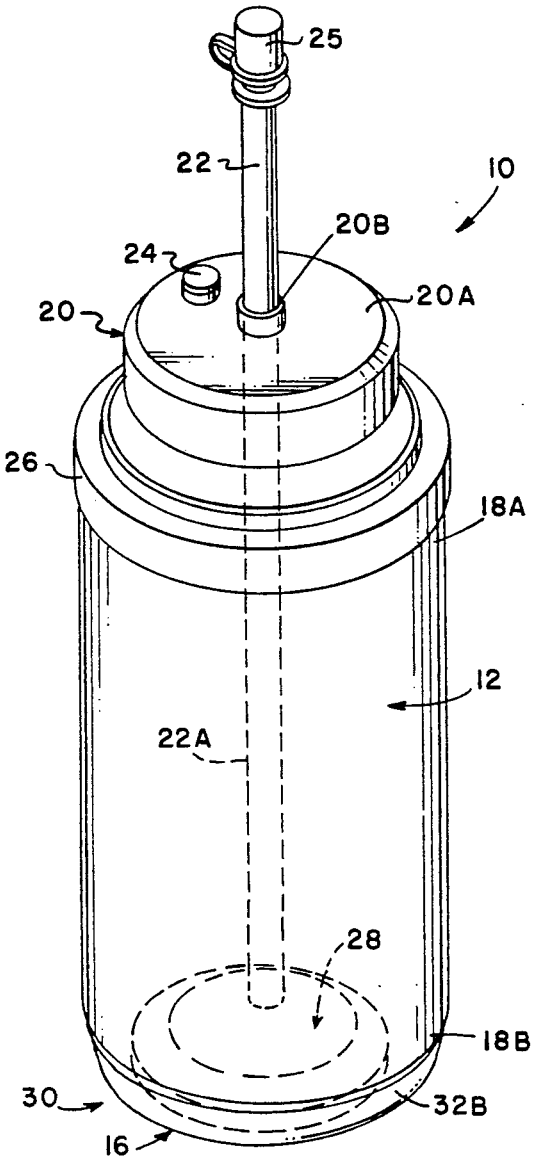
FIG. 1 is a perspective view of a buoyant beverage container constructed according to the teachings of the present invention.

In the description which follows, like parts are indicated throughout the specification and drawings with the same reference numerals, respectively. The drawings are not necessarily to scale and the proportions of certain parts have been exaggerated to better illustrate details of the invention.

Figure 2:
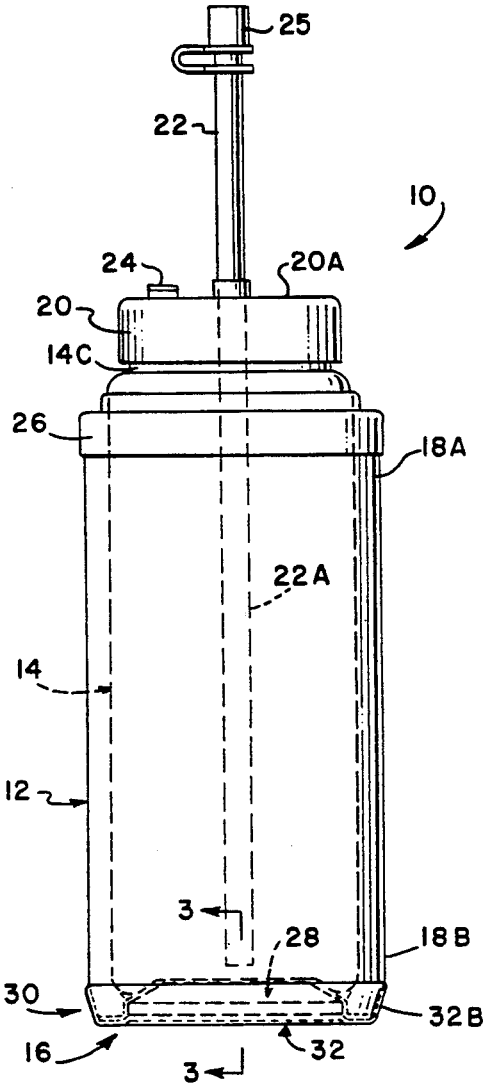
FIG. 2 is a front elevational view thereof.
Figure 3:
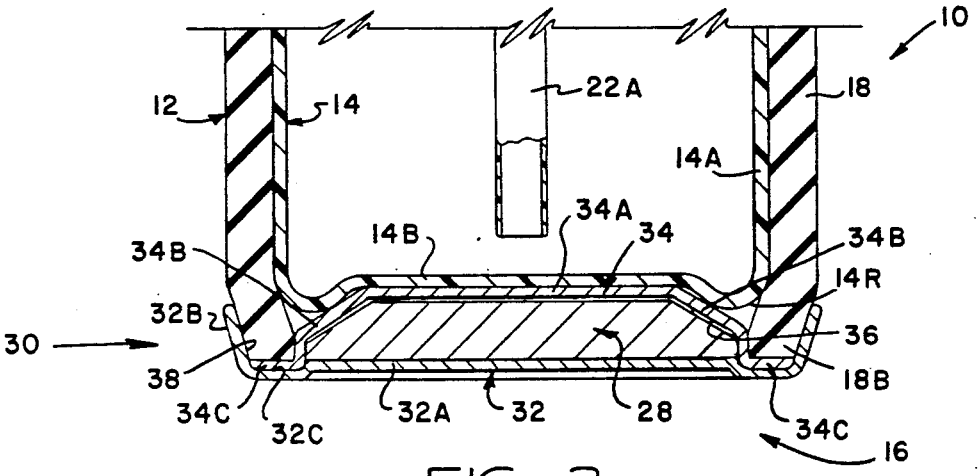
FIG. 3 is a sectional view, partially broken away, taken along the lines 3—3 of FIG. 2.
Figure 8:
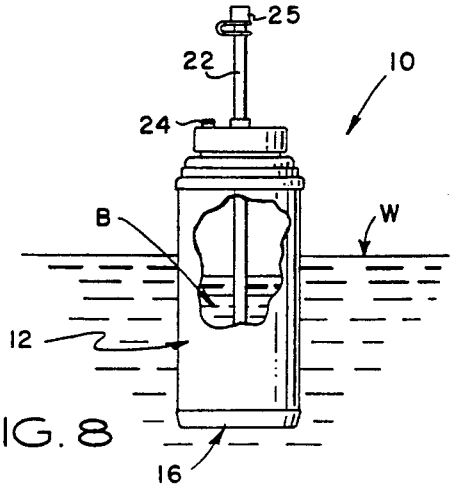
FIG. 8 is an elevation view, partially broken away, of the buoyant beverage container of FIG. 1 shown floating upright in a body of water.
Figure 9:
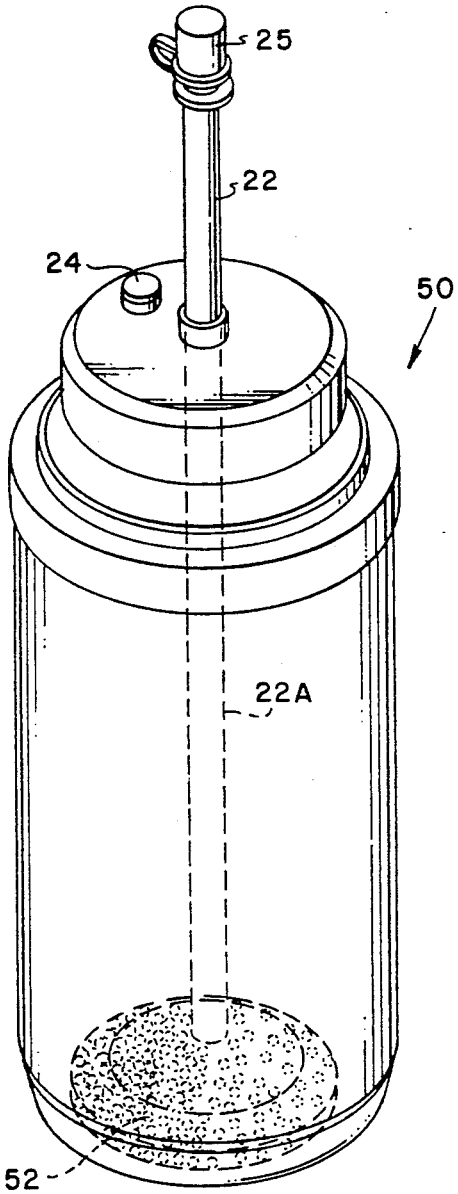
FIG. 9 is a perspective view similar to FIG. 1 which illustrates the use of lead shot a ballast.
Figure 10:
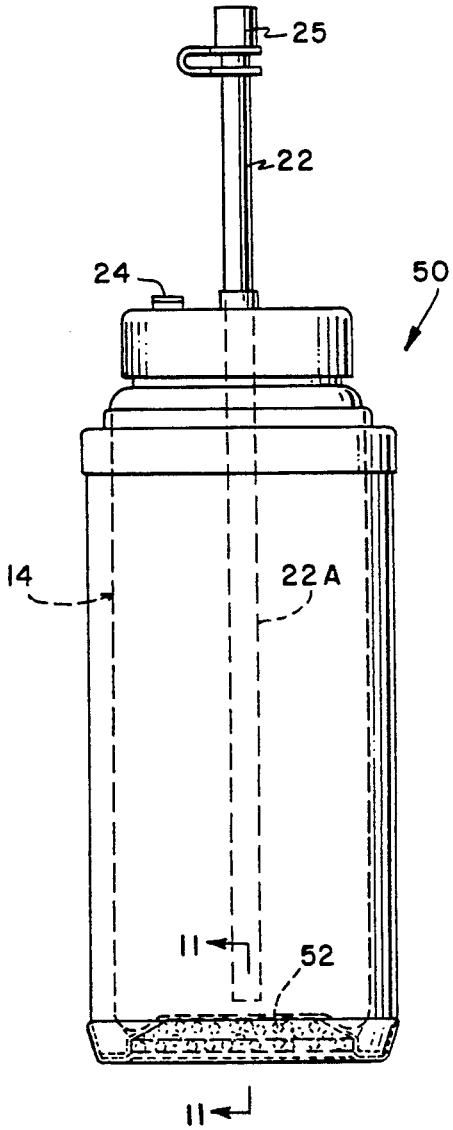
FIG. 10 is a side elevational view of the buoyant beverage container shown in FIG. 9.
Figure 11:
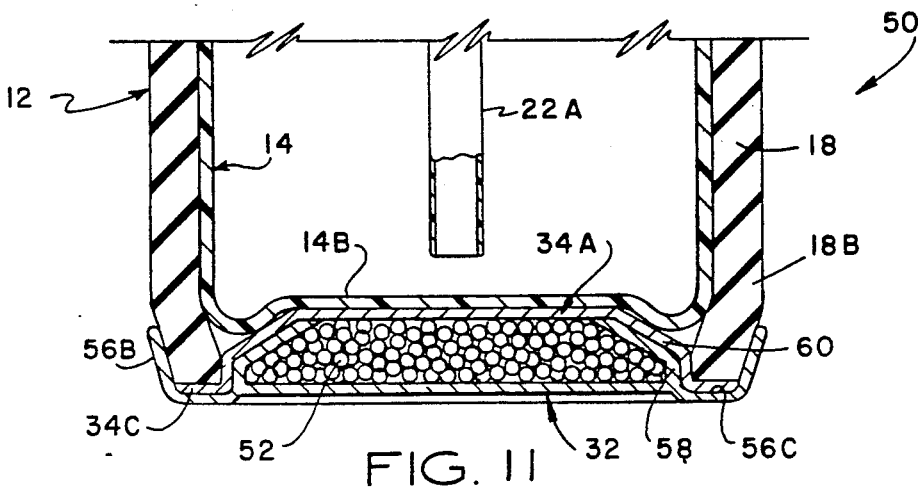
FIG. 11 is a sectional view of the buoyant beverage container shown in FIG. 10, taken along the lines 11—11.
Figure 12:
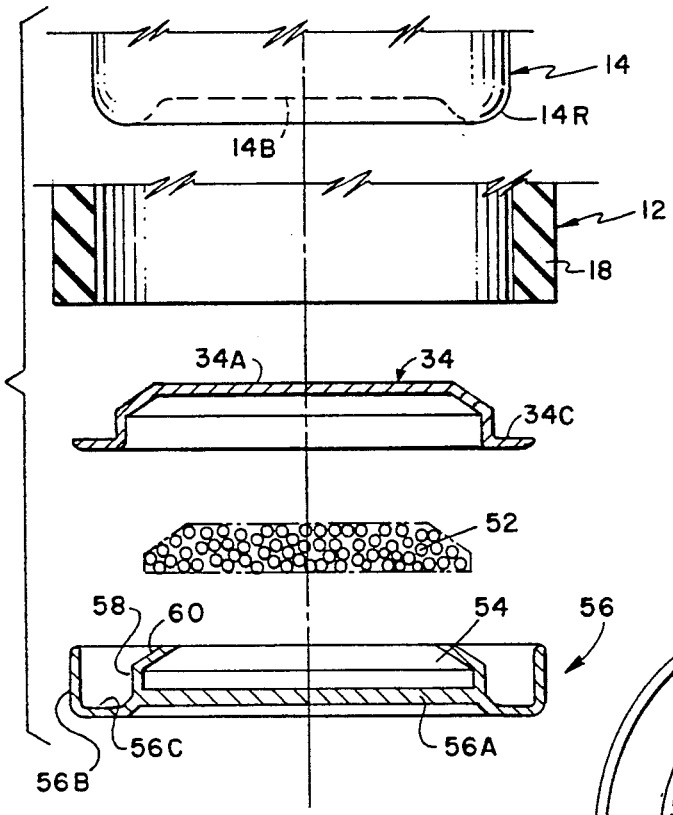
FIG. 12 is an exploded view of the components shown in FIG. 11.
Figure 13:
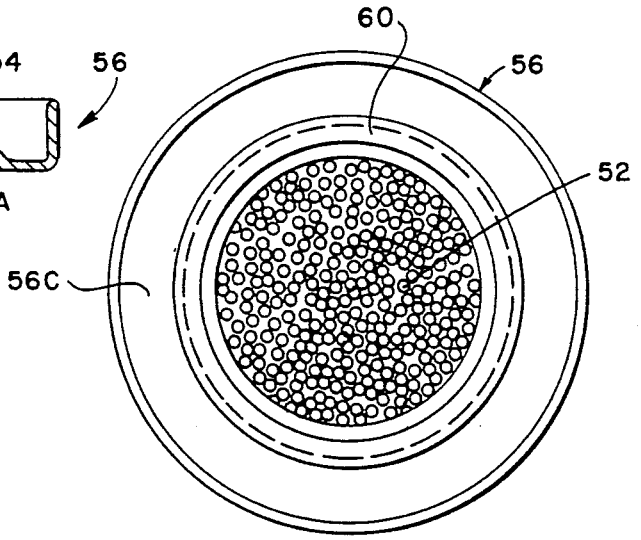
FIG. 13 is a top plan view of the bottom cap shown in FIG. 12, into which lead shot has been loaded.

Referring now to FIG. 1, FIG. 2 and FIG. 3, a beverage container assembly 10 is adapted for use in a swimming pool to provide convenient access to a beverage for persons in the pool. As shown in FIG. 8, the beverage container assembly 10 is adapted to float upright in the water W, and not tip over and spill its beverage contents B during the course of water sports activities.

The principal components of the beverage container assembly are a buoyant sleeve 12, a tubular beverage container 14 and a ballast assembly 16. The sleeve 12 is constructed of a buoyant material, preferably closed cell foam. The sleeve 12 has 18 a cylindrical sidewall 18 and thickness of ¼ inch. The cylindrical sidewall 18 has a receptacle end portion 18A and a base sidewall portion 18B.

The tubular beverage container 14 is made of a flexible polymer material such as polyvinyl chloride (PVC). The beverage container 14 is manufactured in a mold and is provided with a cylindrical sidewall 14A, a closed bottom panel 14B and a threaded neck 14C. A threaded closure cap 20 is secured onto the threaded neck 14C. The closure cap includes a closure panel 20A which is intersected by a beverage dispensing bore 20B. A drinking tube 22 has a lower end portion 22A projecting through the dispensing bore 20B into the interior space of the tubular container 14. The closure cap 20 also has a vent valve 24 for equalizing the pressure within the beverage container 14. The drinking tube 22 has a releasable closure cap 25 for sealing the closure tube while the beverage container assembly is not being used.

The tubular beverage container 14 is received within the bore of the buoyant sleeve 12, and the interface between the buoyant sleeve 12 and the beverage container 14 is sealed by a collar 26. Preferably, the diameter of the beverage container 14 is slightly larger than the inside diameter of the buoyant sleeve 12, whereby the buoyant sleeve 12 is expanded radially as the beverage container 14 is inserted. The frictional engagement between the cylindrical sidewall of the beverage container 14 and the cylindrical sidewall of the buoyant sleeve 12 secures the beverage container 14 and opposes axial displacement of the beverage container relative to the sleeve during use.

The ballast assembly 16 includes a ballast body 28 for maintaining the beverage container assembly 10 in an upright orientation. Preferably, the ballast body 28 is a disc of metal, for example, lead. The weight of the ballast body 28 is carefully selected to maintain the buoyant beverage container assembly 10 upright in a body of water, without sinking when it is filled with beverage, and without turning over on its side when it is empty or almost empty.

The ballast body 28 is secured to the underside of the beverage container 14 by a ballast housing assembly 30 which includes a bottom cap 32 and a retainer cap 34. The bottom cap 32 has a base plate 32A and a collar 32B projecting transversely with respect to the base plate 32A.

Figure 4:
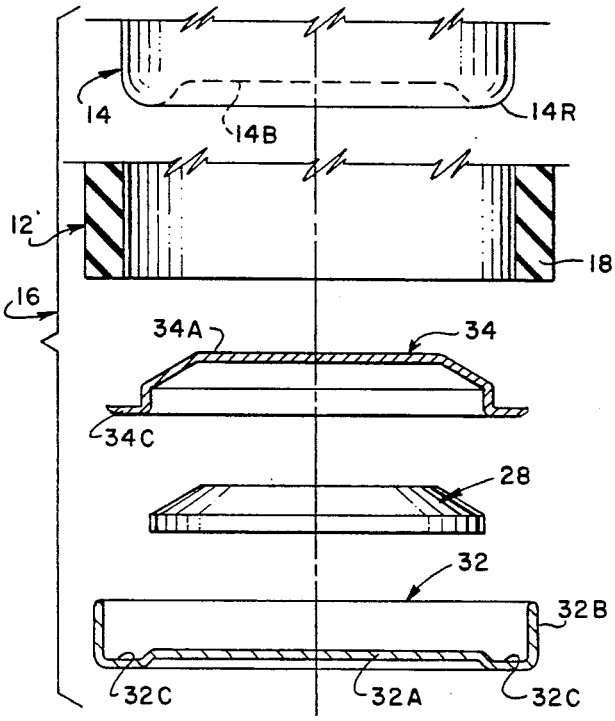
FIG. 4 is an exploded view, partly in section and partly in elevation, of the components shown in FIG. 3.

Referring now to FIGS. 3 and 4, the ballast weight 28 is encapsulate within a ballast chamber 36 formed between the base plate 32 and the retainer plate 34. The retainer cap 34 has a retainer plate 34A axially spaced with respect to the base plate 32A, thereby defining the ballast chamber 36 therebetween. The retainer cap 34 has an annular flange 34B which projects transversely with respect to the retainer cap retaining plate 34A. The retainer cap 34 also has an annular flange 34C which extends substantially parallel with the retainer plate 34A. The bottom cap 32 has an annular channel 32C formed intermediate the base plate 32A and the transverse collar 32B. The annular flange 34C is nested within the annular channel 32C, as can be seen in FIG. 3.

During assembly, the ballast weight 28 is placed onto the retainer plate 32A of the bottom cap 32, and the retainer cap 34 is placed over the ballast weight 28, with its annular flange 34C being received in nesting engagement within the annular pocket 32C. The annular flange 34C is secured onto the bottom cap 32, for example, by a deposit of vinyl adhesive, or by dielectric heat sealing welding.

Next, the tubular beverage container 14 is inserted into the buoyant sleeve 12. A deposit of vinyl adhesive is applied to the base sidewall portion 18B, to the top surface of the flange 34C to the top surface 32C of the bottom cap 32, and to the inside surface of the collar 32B. The base sidewall portion 18B of the buoyant sleeve is then inserted into the annular pocket 38 which is defined between the flange 34B of the retainer cap and the collar 32B of the bottom cap.

The radial dimension of the annular pocket 38 is slightly smaller than the radial thickness of the base sidewall portion 18B. Consequently, the collar 32B is deflected radially outwardly in response to full insertion of the base sidewall portion 18B into the annular pocket 38, as can be seen in FIG. 3. The base sidewall portion 18B of the buoyant sleeve is secured onto the ballast housing assembly 30 by a deposit of vinyl adhesive. As shown in FIG. 3, the base sidewall portion 18B has three bonding surfaces which interface with the bottom cap collar 32, the retainer cap flange 34C and the retainer cap flange 34B, respectively. Additionally, the base sidewall portion 18B is compressed and seized between the bottom rim 14R of the beverage container and the bottom cap collar 32B.

Figure 5:
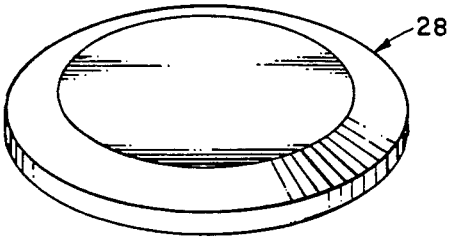
FIG. 5 is a perspective view of a ballast disc.
Figure 5A:
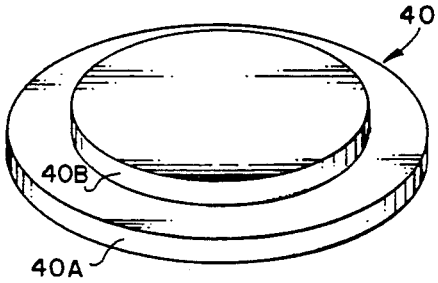
FIG. 5A is a perspective view of a pair of ballast discs which are stacked together in pyramid relation.

Referring now to FIG. 5 and FIG. 5A, the ballast body 28 is preferably in the form of an integrally molded disc having a conical projection which is truncated. However, other ballast body configurations may be used to good advantage, for example, the stacked disc arrangement as shown in FIG. 5A. In that arrangement, the stacked ballast assembly 40 has a large disc 40A on which a smaller disc 40B is stacked.

Figure 6:
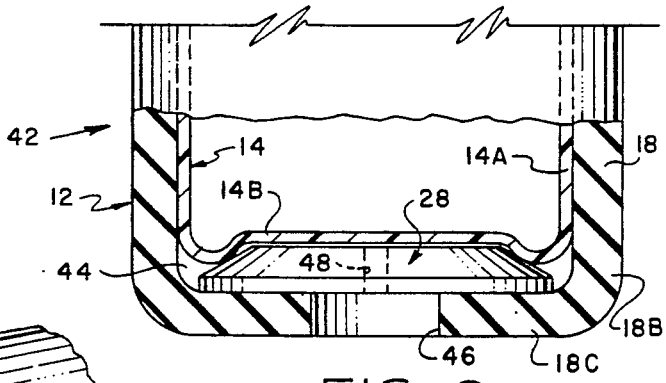
FIG. 6 is an elevation view, partially broken away and partially in section, of an alternative embodiment of the invention.
Figure 7:
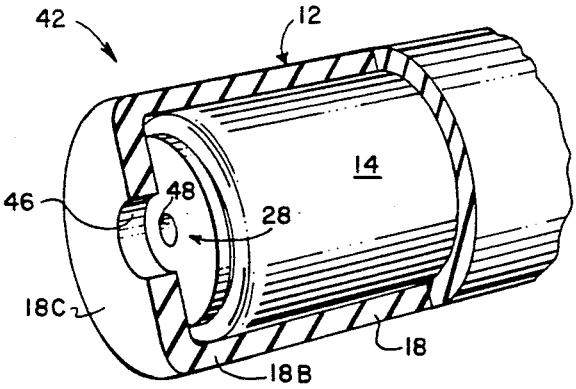
FIG. 7 is a perspective view, partially broken away, of the assembly shown in FIG. 6.

Referring now to FIG. 6 and FIG. 7, an alternative embodiment of a beverage container assembly 42 is illustrated. In this embodiment, an external ballast housing assembly is not utilized. Instead, the buoyant sleeve 12 includes an integrally formed bottom panel 18C which in combination with the closed bottom panel 14B of the beverage container 14 defines a ballast chamber 44 in which the ballast body 28 is confined. Because the diameter of the beverage container 14 is slightly larger than the inside diameter of the buoyant sleeve 12, the cylindrical sidewall of the beverage container 14 is held in tight frictional engagement by the cylindrical sidewall 18. The frictional engagement opposes axial displacement of the beverage container relative to the sleeve during use, and secures the ballast body 28 within the ballast chamber 44.

Because of the tight fit, it is desirable to provide a vent bore 46 through the bottom panel 18C, and also a vent bore 48 through the ballast body 28. The vent openings 46, 48 permit the expulsion of air during insertion of the beverage container 14 into the buoyant sleeve 12 and prevent a vacuum during removal of the beverage container from the tubular sleeve.

Referring now to FIG. 9, FIG. 10, FIG. 11, FIG. 12 and FIG. 13, a beverage container assembly 50 is constructed according to an alternative embodiment of the invention. In this embodiment, the ballast body is formed by a collection of lead shot 52, for example, No. 6 size. The total number of lead shot is selected to yield the desired ballast weight, for example, 13 ounces. In this embodiment, the collection of lead shot 52 is enclosed within a ballast pocket 54. The ballast pocket is formed in a bottom cap 56. The bottom cap 56 has a base plate 56A and a collar 56B. The bottom cap 56 has a pocket sidewall 58 from which a conical sidewall 60 is attached. The cylindrical sidewall 58 is joined to the bottom plate 56A, with the cylindrical sidewall 58 and conical sidewall 60 defining the ballast pocket 54. Additionally, the cylindrical sidewall 58 is radially spaced with respect to the bottom cap collar 56B, thereby defining an annular pocket 56C.

During assembly, the collection of lead shot 52 is loaded into the ballast pocket 54. Thereafter, the retainer cap 34 is inserted over the ballast housing 58, with the annular flange 34C being received in nested engagement within the annular pocket 56C. The annular flange 34C is joined to the bottom cap 56 by an adhesive deposit, or by sonic welding. Thereafter, the beverage container 14 is inserted into the buoyant sleeve 12. The base sidewall portion 18B of the buoyant sleeve is then inserted into the annular pocket 56C. The radial thickness of the annular pocket 56C is slightly smaller than the radial thickness of the base sidewall portion 18B, with the result that the collar 56B is deflected radially outwardly in response to full insertion of the base end portion into the annular pocket, substantially in the same manner as shown for the embodiment of FIG. 3. The base end portion 18B of the buoyant sleeve is secured onto the ballast housing assembly 56 by a deposit of epoxy adhesive.

Figure 14:
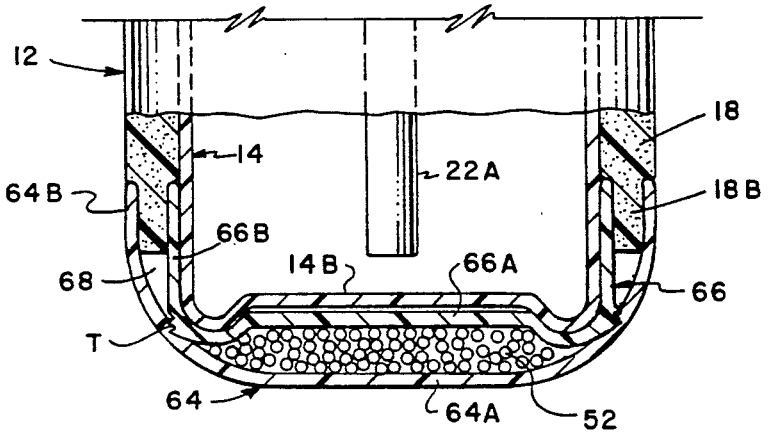
FIG. 14 is an elevational view, partially broken away and partially in section, of yet another embodiment of the present invention.
Figure 15:
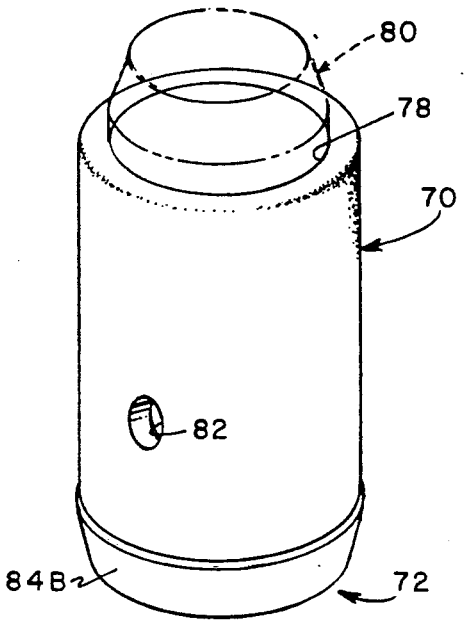
FIG. 15 is a perspective view of an insulated holder which is adapted for use in combination with a beverage container.
Figure 16:
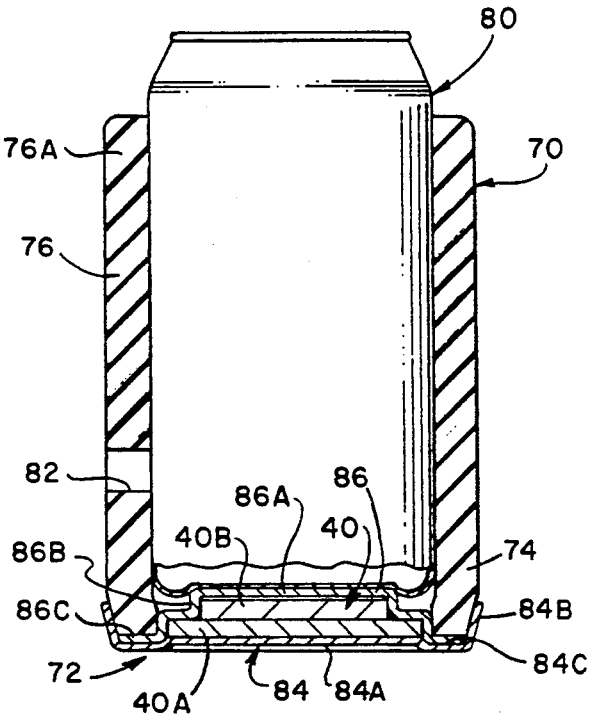
FIG. 16 is a sectional view of the insulated beverage holder shown in FIG. 15.

Referring now to FIG. 14, yet another embodiment of a beverage container assembly 62 is shown in which the ballast body 52 is confined between a bottom cap 64 and a retainer cap 66. It will be understood that either a solid disc or lead shot may be used to form the ballast body 52. In this embodiment, the bottom cap and retainer cap have male and female threads T connected in threaded engagement. The bottom cap 64 has a bottom panel 64A which transitions about a smooth curve to a cylindrical sidewall 64B. The ballast body 52 is confined by a retainer plate 66A which is axially spaced with respect to the bottom plate 64A. The retainer cap 66 has a cylindrical sidewall 66B which is radially spaced with respect to the cylindrical sidewall 64B, thereby defining an annular pocket 68. The base sidewall portion 18B of the thermal sleeve is inserted into the annular pocket 68, and is bonded to the bottom cap sidewall 64B and the retainer cap sidewall 66B by a deposit of vinyl adhesive. Alternatively, the base sidewall portion 18B may be retained therein by frictional engagement between the sidewalls 64B and 66B.

Referring now to FIG. 15, FIG. 16, FIG. 17 and FIG. 18, the upright stability of an insulated beverage holder 70 is improved by a ballast weight assembly 72 which is constructed essentially the same as the ballast weight assembly 30 as shown in FIG. 3, but with the ballast boy 40 of FIG. 5A. According to this arrangement, the beverage holder 70 is made of a thermal insulation material such as closed cell or open cell foam. The insulated beverage holder 70 has a base sidewall portion 74. The insulated beverage holder 70 has a tubular sidewall 76 and a receptacle end portion 76A defining an opening 78 into which a beverage container 80 can be inserted. The sidewall 76 is intersected by a radial bore 82 for venting air as the beverage can 80 is inserted into the insulated holder 70.

The ballast body 40 is preferably formed by a large diameter lead disc 40A and a small diameter disc 40B as shown in FIG. 5A, and is confined between a bottom cap 84 and a retainer cap 86. The bottom cap and retainer cap hold the ballast body 40 in concentric alignment with the holder sidewall 76. The retainer cap 86 has a retainer plate 86A which provides bottom support for the beverage can 80. The bottom cap has a bottom plate 84A and a collar 84B. The retainer cap 86 is axially spaced with respect to the bottom cap 84, thereby defining a ballast chamber. The retainer cap includes an annular flange 86C which is received in nested engagement within the annular pocket 84C, and is bonded to the bottom cap by a deposit of vinyl adhesive.

Figure 17:
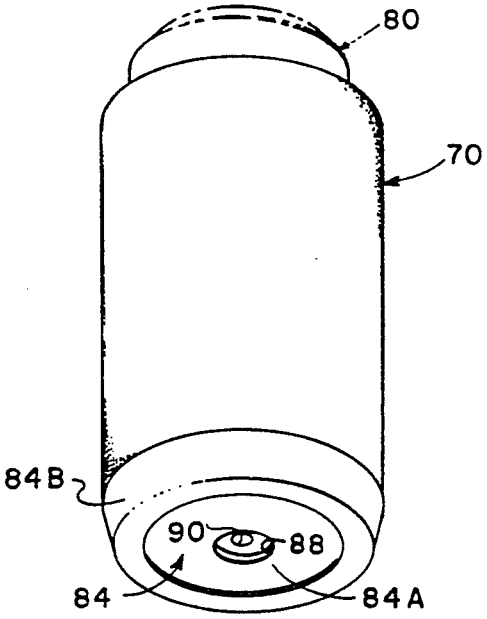
FIG. 17 is a bottom perspective view of an alternate embodiment of an insulated holder for a beverage container.
Figure 18:
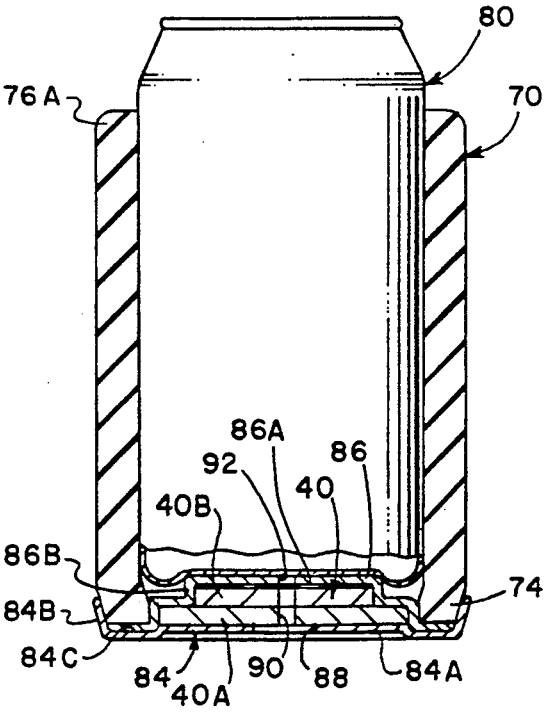
FIG. 18 is a sectional view of the insulated holder shown in FIG. 17.

Referring now to FIG. 17 and FIG. 18, the ballast assembly 72 has vent openings 88, 90 and 92 formed through the bottom plate 84, the ballast body 40 and the retainer plate 86, respectively. The vent openings are aligned to permit expulsion of air during insertion of the beverage container 80 into the insulated holder 70, and to prevent vacuum formation during removal of the beverage container from the insulated holder.

Because of the low center of gravity provided by the ballast body 40, the upright stability of the insulated beverage holder 70 is substantially improved.

Referring now to FIG. 19, FIG. 20, FIG. 21 and FIG. 22, the upright stability of an insulated beverage holder 94 is improved by a ballast weight assembly 96 in which a ballast body 98 is formed by a large diameter metal disk 100, and a small diameter metal disk 102. The disks 100, 102 are preferably made of lead, and are cylindrical in form, similar to the ballast body assembly shown in FIG. 5A. The ballast body 98 is confined between a bottom cap 104 and a retainer cap 106. The bottom cap 104 and retainer cap 106 hold the ballast body 98 in concentric alignment with the holder sidewall 94. The retainer cap 106 has a retainer plate 106A which provides bottom support for the beverage can 80. The bottom cap has a bottom plate 104A which supports the ballast body 98. The retainer cap 106 is axially spaced with respect to the bottom cap 104, thereby defining a ballast chamber in which the ballast body 98 is confined.

According to an important feature of this embodiment, the retainer cap 106 has a radially stepped, cylindrical sidewall 106B, a first annular flange 106C, a second cylindrical sidewall 106D and a second annular flange 106E. The foregoing cylindrical sidewalls and annular flanges are adapted to receive the small diameter and large diameter ballast disks 102, 104 in nesting engagement and in concentric alignment with the longitudinal axis of the insulated holder 94. The bottom cap 104 includes an annular flange 104B. The annular flanges 104B and 106E have the same outside diameter as the insulated holder 94. The outside diameter of the cylindrical sidewall 106D is substantially equal to the inside diameter of the insulated holder 94. The bottom flange 104B is bonded to the top flange 106E by a deposit of vinyl adhesive.

The beverage holder 94 is made of an insulation material such as closed cell or open cell foam. The insulated beverage holder 94 has a receptacle end portion 94A into which the beverage container 80 can be inserted. The insulated holder 94 also has a base sidewall portion 94B which is secured to the ballast weight assembly 96 by a deposit of vinyl adhesive.

Figure 19:
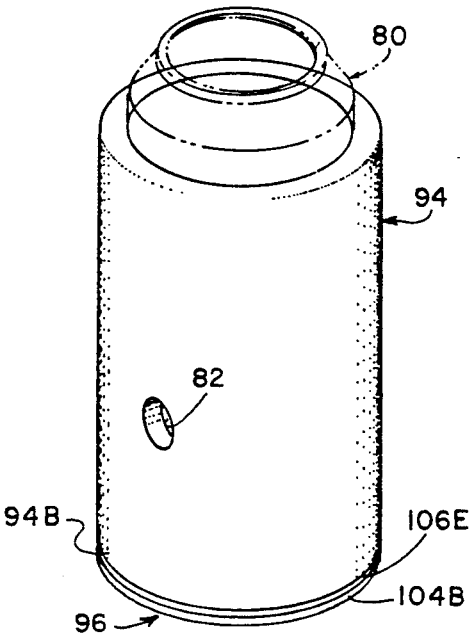
FIG. 19 is a perspective view of an insulated holder which is adapted for use in combination with a beverage container.
Figure 20:
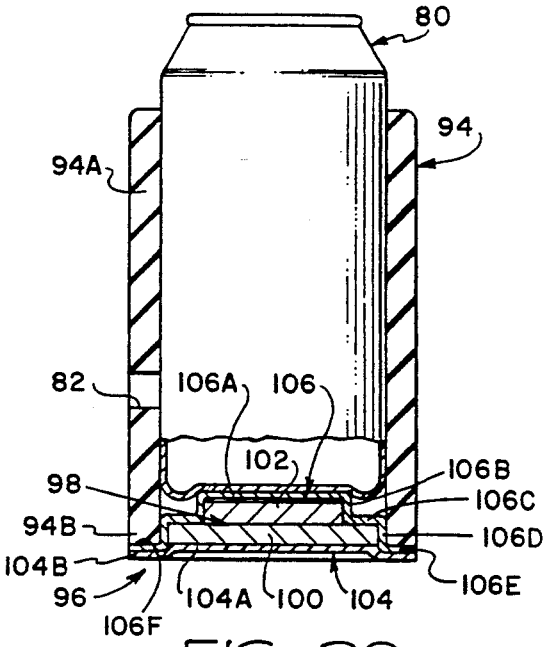
FIG. 20 is a sectional view of the insulated beverage holder shown in FIG. 19.
Figure 21:
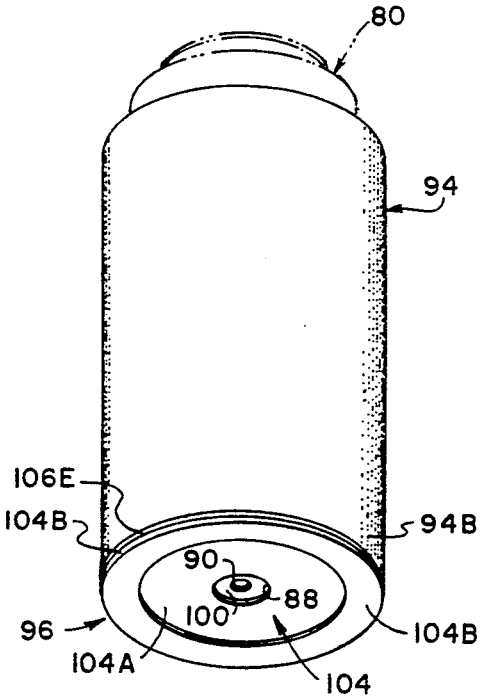
FIG. 21 is a bottom perspective view of an alternate embodiment of an insulated holder for a beverage container.
Figure 22:
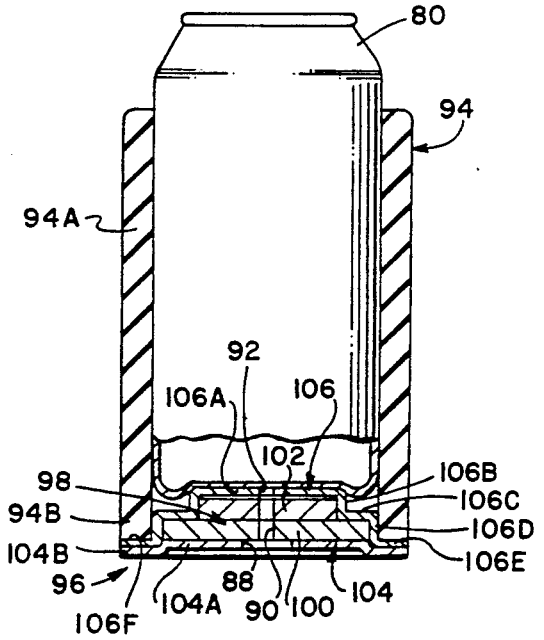
FIG. 22 is a sectional view of the insulated holder shown in FIG. 21.

The ballast weight assembly 96 is assembled by loading the small disk 102 and the large disk 100 into the cylindrical cavities formed by the cylindrical sidewalls 106B and 106D of the retainer cap 106. The retainer cap 106 is then loaded onto the base cap 104, and is bonded thereto. Next, the beverage container 80 is inserted into the open end of the holder sidewall 94A. A deposit of adhesive is then applied to the external sidewall surface of the cylindrical sidewall portion 106D, and also to the external annular face of the annular flange 106E. The retainer cap 106 is then inserted into the lower end portion 94B of the beverage holder 94, with the lower end portion of the tubular sidewall 94B engaging the annular face 106F of the retainer cap 106. The sidewall of the beverage holder 94 has a radial bore 82 for venting air as a beverage can 80 is inserted into the open sidewall 94A (FIG. 19, FIG. 20). In FIG. 21 and FIG. 22, the base plate 104 has a vent opening 88, and the large diameter ballast disk 100, and small diameter ballast disk 102 are intersected by a vent bore 90. The retainer cap has a vent opening 92 which in combination with the vent bores 88, 90 permit expulsion of air during insertion of the beverage container 80 into the beverage holder 94.

Figure 23:
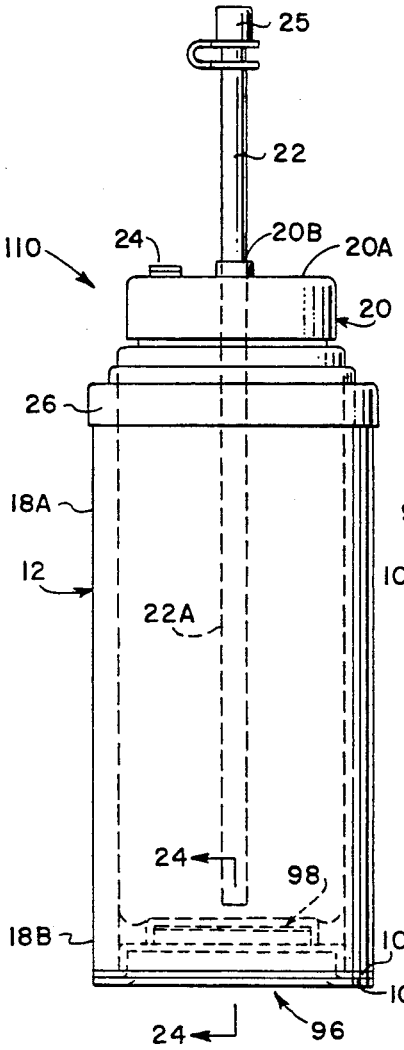
FIG. 23 is a front elevational view of a buoyant beverage container constructed according to an alternative embodiment of the present invention.
Figure 24:
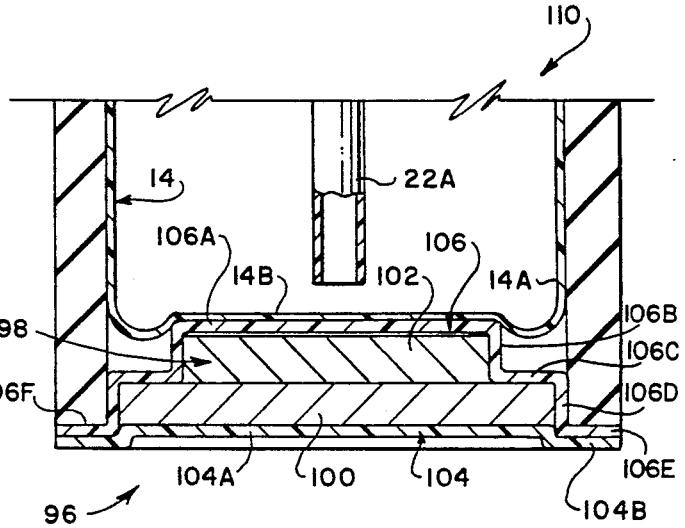
FIG. 24 is a sectional view, partially broken away, taken along the lines 24—24 of FIG. 23.

Referring now to FIG. 23 and FIG. 24, a beverage container 110 constructed according to an alternative embodiment incorporates the ballast weight assembly 96 of FIG. 20. In this embodiment, the bottom panel 14B of the tubular beverage container 14 is supported by the ballast weight assembly 96. However, an external collar is not utilized; instead, the base end portion 18B of the buoyant sidewall 12 is bonded onto the ballast weight assembly 96 by a deposit of vinyl adhesive which is applied to the annular face 106F and the external surface of the cylindrical sidewall 106D. The tubular sidewall 12 has an inside diameter which is substantially equal to the outside diameter of the cylindrical sidewall portion 106D o the retainer cap, and has an outside diameter which is substantially equal to the outside diameter of the annular flange 106E. According to this arrangement, the tubular sidewall 12 is in flush alignment with the external cylindrical side surfaces of the annular flange 106E and annular flange 104B.

Figure 25:
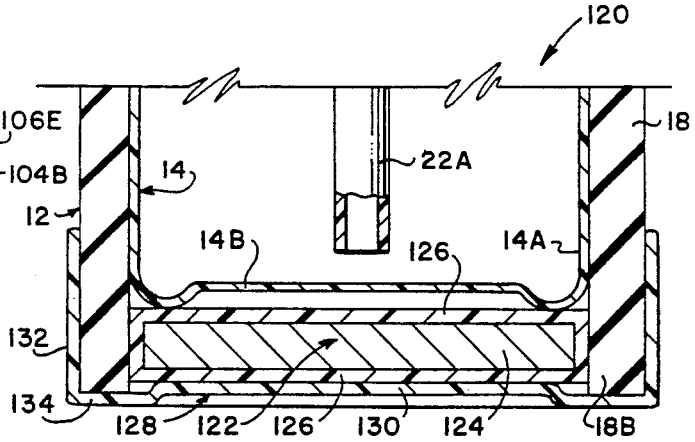
FIG. 25 is a sectional view, similar to FIG. 24, showing an alternative embodiment in which the ballast weight is encapsulated within a plasticized resin coating.

A beverage container 120 is illustrated in FIG. 25. In this alternative embodiment, a ballast weight assembly 122 includes a ballast body 124 which is preferably a lead disc. The ballast body 124 is totally encapsulated within a plasticized resin coating 126. The resin coating 126 is preferably plastisol, which is the generic name for a plasticized resin coating containing a dispersion of finely divided resin in a plasticizer. A suitable composition is 100 parts resin and 50 parts plasticizer, forming a paste that gels when heated to about 300 degrees F as a result of solvation of the resin particles by the plasticizer. Plastisol is available from a number of commercial sources, including PDI, Inc. of Blaine, MN. The plastisol coating is applied by dipping the ballast body 124 into a vat of the liquified plastisol composition to form a continuous covering or coating 126 having an average thickness in the range of 1/16 inch -⅛ inch. The coated ballast body 122 is placed within an oven and is cured at a temperature of about 300 degrees F.

Preferably, a volatile solvent is included in the plastisol composition so that the resin coating 126 is self-curing at room temperature. If a volatile solvent is included in the composition, the plastisol is referred to as an organosol (Q.V.).

In the embodiment of FIG. 25, a retainer cap is not utilized. Instead, the ballast weight assembly 122 is loaded directly onto a bottom cap 128 and is bonded by a deposit of vinyl adhesive to a bottom plate 130 which forms a part of the bottom cap 128. The bottom cap 128 also includes a cylindrical collar 132 and an annular flange 134 which joins the cylindrical collar 132 to the base plate 130.

The beverage container assembly 120 is assembled by applying a deposit of vinyl adhesive onto the inside surface of the bottom plate 130 and thereafter loading the ballast weight assembly 122 onto the bottom plate 130. A deposit of vinyl adhesive is applied to the inside cylindrical surface of the collar 132 and also onto the inside surface of the annular flange 134. Next, the beverage container 14 is inserted through the open end of the tubular sidewall 12. A deposit of vinyl adhesive is applied to the inside surfaces of the cylindrical collar 132 and the annular flange 134, and also to the external surfaces of the tubular base sidewall 18B. The tubular base sidewall end portion 18B is then inserted into the annular space between the ballast weight assembly 122 and the cylindrical collar 132. As shown in FIG. 25, the bottom panel 14B of the beverage container 14 preferably engages the top of the ballast weight assembly 22, but is not bonded thereto. If desired, the beverage container 14 can be withdrawn out of the buoyant sleeve 12 for cleaning or replacement, as desired.

Figure 26:
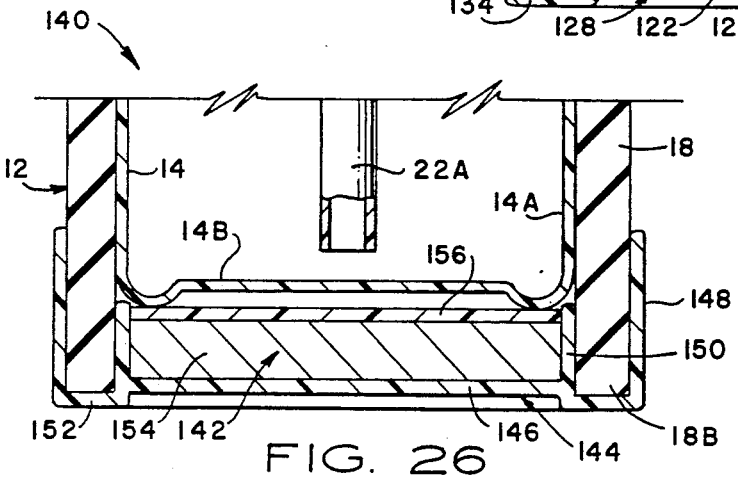
FIG. 26 is a sectional view, similar to FIG. 25, of a buoyant beverage container constructed according to an alternative embodiment of the present invention.

Referring now to FIG. 26, an alternative embodiment of a beverage container assembly 140 is illustrated. In this embodiment, a ballast weight assembly 142 is sealed within a bottom cap assembly 144. The bottom cap assembly 144 includes a bottom plate 146, an external cylindrical collar 148 and an internal cylindrical collar 150 which is radially spaced from the external cylindrical collar, thereby defining an annular pocket in which the tubular base sidewall portion 18B of the buoyant sleeve 12 is received. The base plate 146, the external cylindrical collar 148 and the internal cylindrical collar 150 are joined together by an annular flange 152. Preferably, the internal collar 150, external collar 148, base plate 146 and annular flange 152 are integrally formed of a durable plastic material such as polyvinylchloride (PVC).

In this embodiment, the ballast weight assembly 142 includes a lead disc 154 which is inserted into the cylindrical cavity formed within the internal cylindrical collar 150. Preferably, the lead disc 154 is bonded to the bottom plate 146 by a deposit of vinyl adhesive. Next, the ballast body 154 is completely sealed within the internal cylindrical collar 150 by a deposit 156 of an encapsulation composition, such as plastisol as discussed above. The plastisol deposit 156 has a thickness in the range of 1/16 inch –⅛ inch, and forms an airtight seal across the top of the lead disc 154 and across the internal cylindrical collar 150.

The beverage container assembly 140 is thereafter assembled in substantially the same way a the embodiment shown in FIG. 5. After a deposit of vinyl adhesive has been applied to the internal collar, the external collar and the annular flange, the tubular base sidewall portion 18B is inserted into the annular pocket formed between the internal cylindrical collar and the external cylindrical collar. Since the ballast body 154 is completely sealed and secured by the plastisol deposit 156, a retainer cap is not needed.

Figure 27:
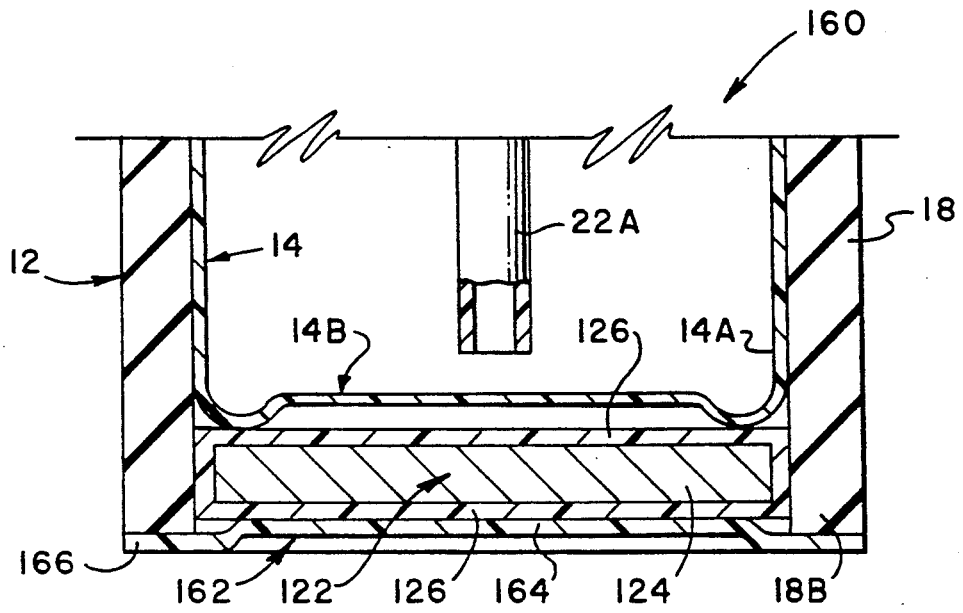
FIG. 27 is a view similar to FIG. 25, showing an alternative embodiment thereof; and, FIG. 28 is a sectional, similar to FIG. 26, of an alternative embodiment thereof.

Referring now to FIG. 27, a beverage container 160 constructed according to an alternative embodiment incorporates the ballast weight assembly 122 of FIG. 25. In this embodiment, however, an external collar is not utilized; instead, the base end portion 18B of the buoyant sidewall 12 is bonded onto the ballast weight assembly by a deposit of vinyl adhesive which is applied to the external cylindrical surface of the plastisol coating 126 and also onto the inside surface of the annular flange 134. The tubular sidewall 12 has an inside diameter which is substantially equal to the outside diameter of the encapsulated ballast body 122, and has an outside diameter which is substantially equal to the outside diameter of the annular flange 134. In this arrangement, the ballast weight assembly 122 is loaded directly onto a bottom cap 162 and is bonded thereto by a deposit of vinyl adhesive to a bottom plate 164 which forms a part of the bottom cap 162. The bottom cap 162 includes an annular flange portion 166 which is bonded to the tubular base portion 18B of the buoyant sidewall 12. The beverage container assembly 160 is assembled by applying a deposit of vinyl adhesive onto the inside surface of the bottom plate 164 and thereafter loading the ballast weight assembly 122 onto the bottom plate 164. A deposit of vinyl adhesive is applied to the external cylindrical surface of the plastisol coating 126, and also to the inside surface of the annular flange 166. The ballast body assembly is inserted into the lower end of the buoyant sleeve 12, so that the tubular sidewall 12 is in flush alignment with the external cylindrical side surfaces of the annular flange 166.

Figure 28:
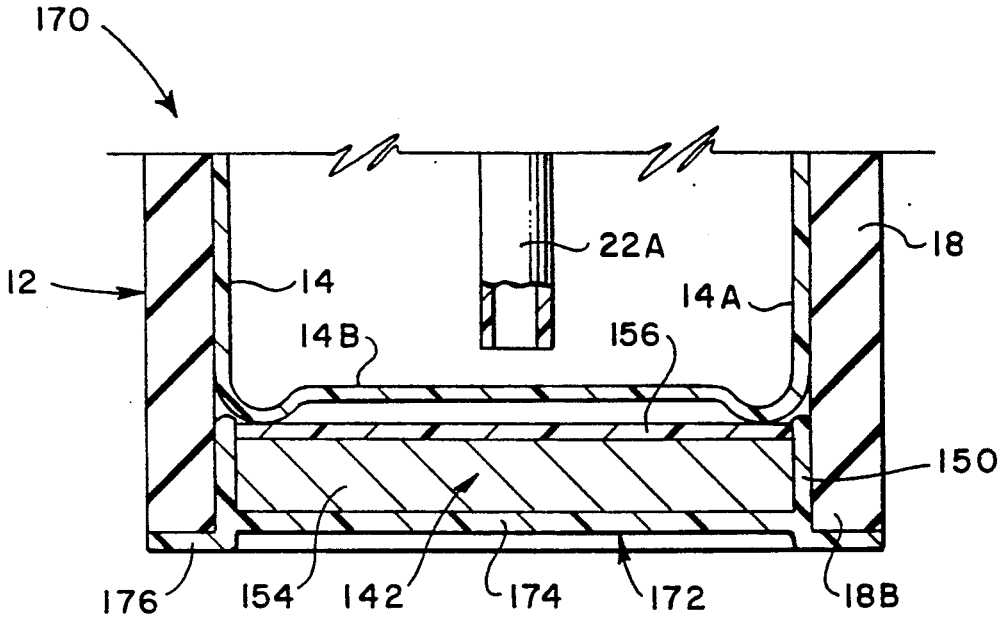

Referring now to FIG. 28, a beverage container 170 constructed according to an alternative embodiment includes the ballast weight assembly 142 of FIG. 26. In this embodiment, however, an external collar is not utilized; instead, the ballast weight assembly 142 is loaded onto a bottom cap 172 which has a base plate 174 and an annular flange 176, but does not have an external collar. In this arrangement, the base end portion 18B of the buoyant sidewall 12 is bonded onto the external surface of the cylindrical collar 150 and onto the annular flange 176 by a deposit of vinyl adhesive. In this embodiment, the base end portion 18B of the tubular sidewall 12 is in flush alignment with the external cylindrical side surface of the annular flange 176.

Although the invention has been described in part by making detailed references to certain specific embodiments, such detail is intended to be, and will be understood to be, instructional rather than restrictive. It will be appreciated by those skilled in the art that variations may be made in the structure and method of assembly without departing from the spirit and scope of the invention as disclosed herein.

What is claimed is:

1. A beverage container assembly which is adapted to float upright in a swimming pool comprising, in combination:

a tubular sidewall of buoyant material;

a beverage container having a tubular sidewall, a closed bottom panel and a closure cap adapted for dispensing a beverage, said beverage container being received within said tubular sidewall;

a ballast housing assembly including a bottom cap and a retainer cap;

said bottom cap having a base plate and a collar attached to said base plate, said collar projecting transversely with respect to said base plate;

said retainer cap being secured to said bottom cap and having a retainer plate axially spaced with respect to the base plate thereby defining a ballast chamber, said retainer cap having an annular flange attached to the base plate, said annular flange being radially spaced with respect to said collar, thereby defining an annular pocket therebetween;

a ballast body disposed in the ballast chamber; and, the tubular sidewall of buoyant material being received within the annular pocket and secured to said ballast housing assembly.

2. A beverage container assembly as defined in claim 1, said ballast body comprising a solid metal disc.

3. A beverage container assembly as defined in claim 1, said ballast body comprising a collection of metal shot.

4. A beverage container assembly as defined in claim 1, said ballast body comprising a first metal disc and a second metal disc, said second metal disc being stacked on said first metal disc.

5. beverage container assembly as defined in claim 1, said buoyant material comprising polymer foam.

6. A beverage container assembly as defined in claim 1, said closure cap having a closure panel intersected by a beverage dispensing bore, said assembly including a drinking tube projecting through dispensing bore into said tubular container.

7. A beverage container assembly as defined in claim 1, said retainer cap and said base plate having male and female threads disposed in threaded engagement.

8. A beverage container assembly which is adapted to float upright in water comprising, in combination:

a tubular sidewall of buoyant material, said tubular sidewall having an open end, a closed end and a chamber therebetween, said closed end including a bottom panel;

a beverage container having a tubular sidewall, a closed bottom panel and a closure cap adapted for dispensing a beverage, said beverage container being received within said tubular sidewall chamber with the closed bottom panel of the beverage container being axially spaced with respect to said sidewall bottom panel, thereby defining a ballast chamber therebetween; and, a ballast body disposed in the ballast chamber, said ballast body comprising first and second metal discs, said first and second metal discs being stacked within said ballast chamber.

9. A beverage container assembly as defined in claim 8, said buoyant material comprising closed cell polymer foam.

10. A beverage holder adapted for thermally insulating a beverage container comprising, in combination:

a tubular sidewall of thermal insulation material, said tubular sidewall having a receptacle end portion adapted to receive a beverage container, and having a base sidewall portion;

a ballast housing assembly including a bottom cap and a retainer cap;

said bottom cap having a base plate portion and a collar attached to said base plate portion, said collar projecting transversely with respect to said base plate portion;

said retainer cap being secured to said bottom cap, said retainer cap having a retainer plate axially spaced with respect to the base plate, thereby defining a ballast chamber, and said retainer cap having an annular flange attached to the base plate, said annular flange being radially spaced with respect to said collar, thereby defining an annular pocket therebetween;

a ballast body disposed in the ballast chamber; and, the base sidewall portion of the tubular sidewall being received within the annular pocket and secured to said ballast housing assembly.

11. A thermally insulated holder for a beverage container as defined in claim 10, said tubular sidewall being intersected by a vent opening.

12. A thermally insulated holder for a beverage container as defined in claim 10, a metal disc, said retainer plate and said base plate being intersected by a vent opening.

13. A thermally insulated holder for a beverage container as defined in claim 10, said thermal insulation material comprising polymer foam.

14. A thermally insulated holder for a beverage container as defined in claim 10, said ballast body comprising a solid metal disc.

15. A thermally insulated holder for a beverage container as defined in claim 10, said ballast body comprising a collection of metal shot.

16. A thermally insulated holder for a beverage container as defined in claim 10, said ballast body comprising a first metal disc and a second metal disc, said second metal disc being stacked on said first metal disc.

17. A thermally insulated holder for a beverage container as defined in claim 10, said retainer cap and said base plate having male and female threads, respectively, disposed in threaded engagement.

18. A beverage container assembly which is adapted to float upright in a swimming pool comprising, in combination:

a tubular sidewall of buoyant material;

a beverage container having a tubular sidewall, a closed bottom panel and closure cap adapted for dispensing a beverage, said beverage container being received within said tubular sidewall;

a ballast housing assembly including a bottom cap, said bottom cap having a base plate and a collar attached to said base plate, said collar projecting transversely with respect to said base plate;

a ballast body mounted on said base plate and radially spaced with respect to said collar, thereby defining an annular packet therebetween;

said ballast body including a solid metal disc which is encapsulated by a resinous coating; and, the tubular sidewall of buoyant material being received within the annular pocket and secured to said ballast housing assembly.

19. A beverage container assembly as defined in claim 18, said resinous coating comprising plastisol.

20. A beverage container assembly as defined in claim 18, said buoyant material comprising polymer foam.

21. A beverage holder adapted for thermally insulating a beverage container comprising, in combination:

a tubular sidewall of thermal insulation material, said tubular sidewall having a receptacle end portion adapted to receive a beverage container, and having a base sidewall portion;

a ballast housing assembly including a bottom cap, said bottom cap having a base plate portion and a collar attached to said base plate portion, said collar projecting transversely with respect to said base plate portion;

a ballast body mounted on said base plate and radially spaced with respect to said collar, thereby defining an annular pocket therebetween, said ballast body comprising a solid metal disc encapsulated by a layer of resinous material; and, the base sidewall portion of the tubular sidewall being received within the annular pocket and secured to said ballast housing assembly.

22. A thermally insulated holder for a beverage container as defined in claim 21, said thermal insulation material comprising polymer foam.

23. A thermally insulated holder for a beverage container as defined in claim 21, said resinous material comprising plastisol.

24. A beverage container assembly which is adapted to float upright in a swimming pool comprising, in combination:

a tubular sidewall of buoyant material;

a beverage container having a tubular sidewall, a closed bottom panel and a closure cap adapted for dispensing a beverage, said beverage container being received within said tubular sidewall;

a ballast housing assembly including a bottom cap, said bottom cap having a base plate, an internal collar and an external collar attached to said base plate, said internal and external collars projecting transversely with respect to said base plate and being radially spaced from each other, thereby defining an annular pocket therebetween;

a ballast body disposed within the internal collar;

a layer of sealing material confining said ballast body within the internal collar; and, the tubular sidewall of buoyant material being received within the annular pocket and secured to said ballast housing assembly.

25. A beverage container assembly as defined in claim 24, said ballast body comprising a solid metal disc.

26. A beverage container assembly as defined in claim 24, said sealing material comprising plasticized resin.

27. A beverage container assembly as defined in claim 25, said plasticized resin comprising plastisol.

28. A beverage container assembly as defined in claim 24, said buoyant material comprising polymer foam.

29. A beverage holder adapted for thermally insulating a beverage container comprising, in combination:

a tubular sidewall of thermal insulation material, said tubular sidewall having a receptacle end portion adapted to receive a beverage container, and having a base sidewall portion;

a ballast housing assembly including a bottom cap, said bottom cap having a base plate, an internal collar and an external collar attached to said base plate, said internal and external collars projecting transversely with respect to said base plate and being radially spaced from each other, thereby defining an annular pocket therebetween;

a ballast body disposed within the internal collar;

a layer of sealing material confining the ballast body within the internal collar; and, the base sidewall portion of the tubular sidewall being received within the annular pocket and secured to said ballast housing assembly.

30. A thermally insulated holder for a beverage container as defined in claim 29, said thermal insulation material comprising polymer foam.

31. A thermally insulated holder for a beverage container as defined in claim 29, said ballast body comprising a solid metal disc.

32. A thermally insulated holder for a container as defined in claim 29, said sealing material comprising plasticized resin.

33. A thermally insulated holder for a beverage container as defined in claim 32, said plasticized resin comprising plastisol.

34. A beverage container assembly which is adapted to float upright in a swimming pool or the like comprising, in combination:

a tubular sidewall of buoyant material;

a beverage container having a tubular sidewall, a closed bottom panel and a closure cap adapted for dispensing a beverage, said beverage container being partially enclosed within said tubular sidewall;

a ballast housing assembly including a bottom cap, said bottom cap having a base plate, a collar and an annular flange attached to said base plate, said collar projecting transversely with respect to said base plate and being disposed intermediate said base plate and said annular flange, said collar and base plate defining a ballast pocket;

a ballast body disposed within said ballast pocket;

a layer of sealing material confining said ballast body within said ballast pocket; and, the tubular sidewall of buoyant material being secured to said ballast housing assembly.

35. A beverage container assembly as defined in claim 34, said ballast body comprising a solid metal disc.

36. A beverage container assembly as defined in claim 34, said sealing material comprising plasticized resin.

37. A beverage container assembly as defined in claim 34, said plasticized resin comprising plastisol.

38. A beverage container assembly as defined in claim 34, said buoyant material comprising polymer foam.

39. A beverage container assembly which is adapted to float upright in a swimming pool comprising, in combination:

a tubular sidewall of buoyant material;

a beverage container having a tubular sidewall, a closed bottom panel and closure cap adapted for dispensing a beverage, said beverage container being received within said tubular sidewall;

a ballast housing assembly including a bottom cap, said bottom cap having a base plate and an annular flange attached to said base plate;

a ballast body mounted on said base plate and radially spaced with respect to said annular flange, said ballast body comprising a solid metal disc encapsulated by a layer of resinous material; and, the tubular sidewall of buoyant material being secured to said annular flange with the ballast body being enclosed within the tubular sidewall.

40. A beverage container assembly as defined in claim 39, said buoyant material comprising polymer foam.

41. A beverage container assembly as defined in claim 39, said resinous material comprising plastisol.

* * * * *

UNITED STATES PATENT AND TRADEMARK OFFICE

CERTIFICATE OF CORRECTION

PATENT NO. : 5,088,948

DATED : 02/18/92

INVENTOR(S) : Robert S. Scheurer

It is certified that error appears in the above-identified patent and that said Letters Patent is hereby corrected as shown below:

Column 2, line 68, "a" should be -- as --.

Column 4, line 3, "18", first occurrence, should be omitted.

Column 4, line 51, "encapsulate" should be -- encapsulated --.

Column 6, line 55, "boy" should be -- body --.

Column 8, line 32, "o" should be -- of --.

Column 9, line 52, "a" should be -- as --.

Column 11, line 13, "5. beverage" should be -- 5. A beverage --.

Signed and Sealed this

Twentieth Day of April, 1993

*Attest:*

MICHAEL K. KIRK

*Attesting Officer*

*Acting Commissioner of Patents and Trademarks*